US008048241B1

(12) United States Patent
Davison

(10) Patent No.: US 8,048,241 B1
(45) Date of Patent: Nov. 1, 2011

(54) EXPLOSIVE DEVICE

(75) Inventor: David Davison, Edina, MN (US)

(73) Assignee: Shock Transients, Inc, Hopkins, MN (US)

( * ) Notice: Subject to any disclaimer, the term of this patent is extended or adjusted under 35 U.S.C. 154(b) by 1666 days.

(21) Appl. No.: 10/844,174

(22) Filed: May 12, 2004

Related U.S. Application Data

(60) Provisional application No. 60/470,048, filed on May 13, 2003.

(51) Int. Cl.
*D03D 23/00* (2006.01)

(52) U.S. Cl. ..... 149/19.3; 149/109.6

(58) Field of Classification Search ..... 149/19.3, 149/109.6

See application file for complete search history.

(56) References Cited

U.S. PATENT DOCUMENTS

| | | | | |
|---|---|---|---|---|
| 5,351,623 | A | 10/1994 | Kissel et al. | 102/498 |
| 5,472,536 | A * | 12/1995 | Doris et al. | 149/41 |
| 5,859,383 | A | 1/1999 | Davison et al. | 102/307 |
| 6,357,356 | B1 | 3/2002 | Rim et al. | 102/202.7 |
| 6,389,975 | B1 | 5/2002 | Haddon et al. | 102/219 |
| 6,540,175 | B1 | 4/2003 | Mayersak et al. | 244/315 |

OTHER PUBLICATIONS http://www/dupot-dow.com/Products/Viton/techInfo.asp, "Technical Info," and Viton® Headquarters Information, 3 pages.

http://www/acmerubber.com/viton.htm, "Viton® Fluorelastomer," Cover and pp. 1-16.

Givens, et al., "Electrically Enchanced Energetics" 6th Joint Classified Symposium, NDIA, Jun. 2003 pp. 1-11.

Ford, et al., "High Cloulomb Triggered Vacuum Flashover Switch," Pulsed Power Conference, 1998, pp. 893-898.

Theofanous, T.G., et al. "Ignition of Aluminum Droplets behind Shock Waves in Water," Phys. Fluid 6 (11), Nov. 1994, pp. 3513-3515.

Lee, W.M. "Metal/Water Chemical Reaction Coupled to a Pulsed Electrical Discharge," J. Appl. Physic 69(10), May 15, 1991, pp. 6945-6951.

* cited by examiner

*Primary Examiner* — Aileen B Felton

(74) *Attorney, Agent, or Firm* — Mark A. Litman & Associates, P.A.

(57) ABSTRACT

A high energy, stable, electrically activated explosive replacement comprises at least a mixture of a metal, a highly-halogenated polymer moiety (HHPM) and a reduced (or non-) halogenated polymer moiety (RHPM). These replacements can also be used as detonators, initiators, or explosive devices alone or with other explosive systems and materials. The two polymer moieties, the HHPM and RHPM, may be provided in the following manners and generally in the following proportions. The halogen on the polymer preferably comprises chlorine or fluorine, preferably fluorine, and preferably at least 50% of halogen atoms in the polymer comprise fluorine. The fluorine is preferably provided on the polymer backbone (as in polymers formed from ethylenically unsaturated monomeric units such as tetrafluoroethylene, trifluoromonochloroethylene, difluorodichloroethylene, trichloromonofluoroethylene, trifluoroethylene, and the like).

12 Claims, 2 Drawing Sheets

Pressures and Energies for Teflon/Mylar Blends.

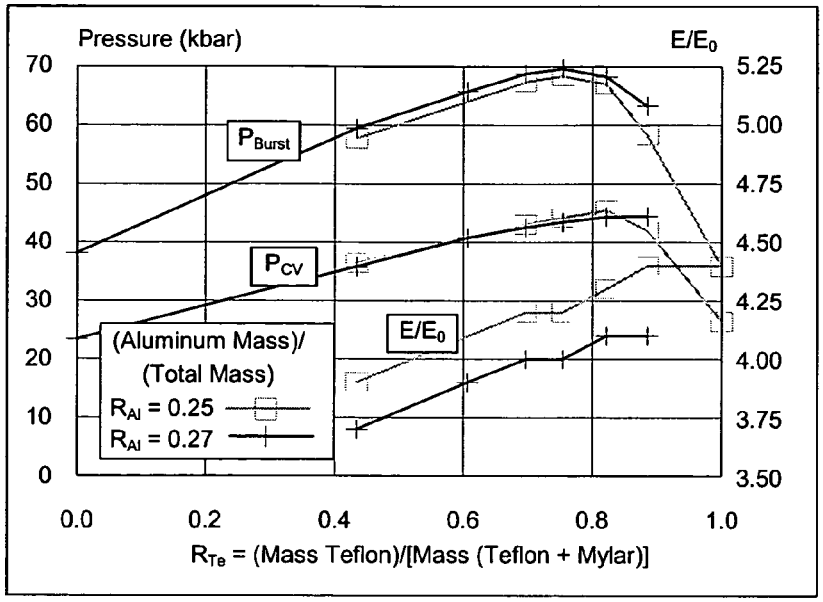
Figure 1. Pressures and Energies for Teflon/Mylar Blends.
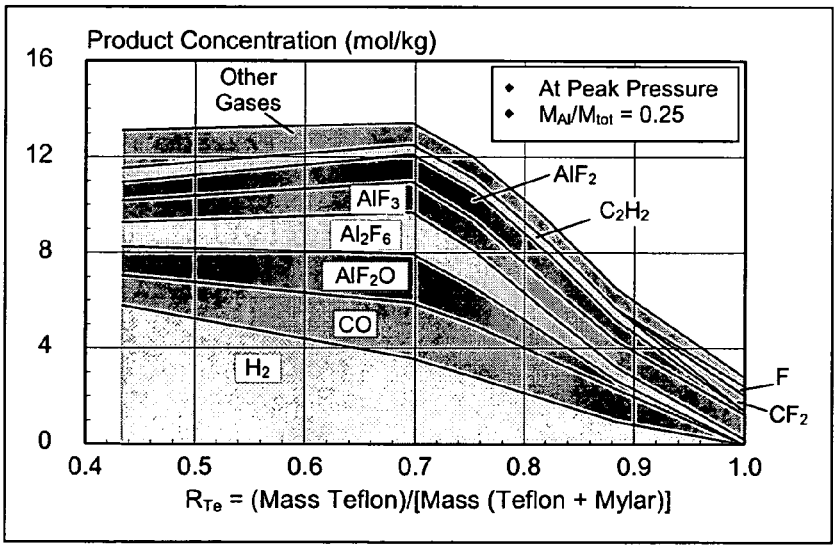
Figure 2. Gas chemistry for aluminum, Mylar, and Teflon reaction.

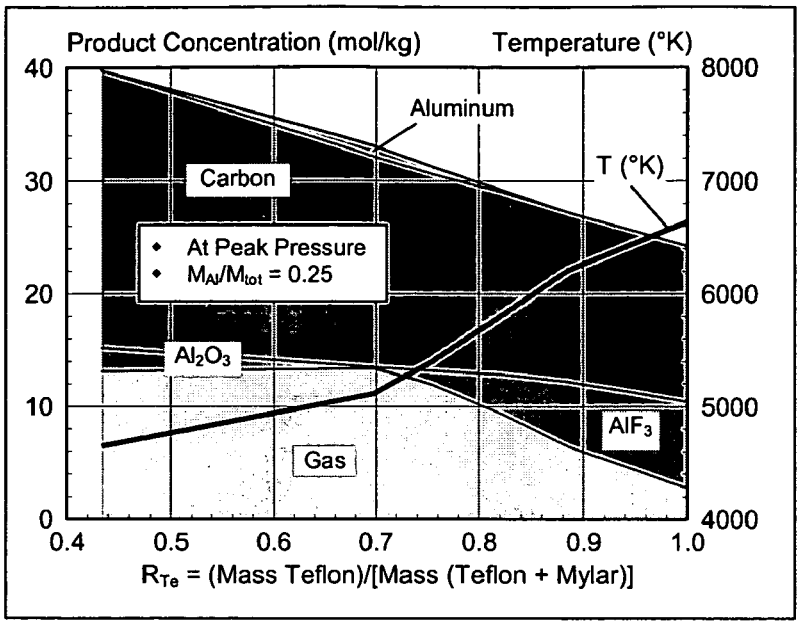
Figure 3. Condensed chemistry for aluminum, Mylar, and Teflon reaction.

EXPLOSIVE DEVICE

RELATED U.S. PATENT APPLICATION DATA

This Application claims priority from Provisional U.S. Patent Application Ser. No. 60/470,048 filed on May 13, 2003.

GOVERNMENT RIGHTS

This invention was made with Government support under contract N00014-02-C-0037, awarded by the Office of Naval Research. The Government has certain rights in the invention. "Certain rights" means that the Government has a paid-up license, as provided in FAR 52.227-11.

BACKGROUND OF THE INVENTION

1. Field of the Invention

The present invention relates to explosive devices, and particularly high pressure explosive devices that can be activated by electrical pulse or ignited by shock.

2. Background of the Art

Explosive devices are used in a wide range of industry and commerce. The very nature of explosives as they have been known for centuries makes them inherently dangerous. Attempts have been made to make them safer.

U.S. Pat. No. 6,540,175 describes an airborne countermine system comprising: at least one munitions dispenser element, a plurality of countermine munitions initially contained within said dispenser element, each of said munitions containing means for guiding said munitions to a predetermined coordinate location, and positioning the same for descent along a substantially vertical axis; means for initiating axial rotation to said countermines during vertical descent; each of said munitions containing a plurality of incendiary darts; means for opening said munitions during descent to radially distribute said darts using generated centrifugal force for individual vertical descent to a target area. The Patent describes high temperature incendiary fill to allow large amounts of chemical energy to be released over short periods of time. The dart high temperature incendiary fill employs an active ignition system to shock the fill up to reaction. High temperature incendiary fill candidates include titanium-boron-Teflon™ with CTBN as the binder, titanium-boron-Teflon™ with Viton®A as the binder, titanium-boron with ammonium perchlorate with Viton®A as the binder, aluminum potassium perchlorate with Viton®A as the binder and aluminum iron oxide with Viton®A as the binder. Viton®A is fluoropolymer elastomer that comes in many different variations of ingredients and properties. It includes copolymers of Tetrafluoroethylene, ethylene and ethers. These fills and high explosive fills may be employed in the countermine dart. The problem experienced with trying to package high temperature incendiary or explosive fills in small diameter countermine flechettes or darts is that it is difficult to ignite the fill in small calibers and maintain high velocity burn rates even in perforated fill designs. End-burners, as compared to perforated fill designs, burn at even slower burn rates and the ability to maintain the burn, due to heat transfer losses during the burn to the case of the countermine dart, is difficult. The use of an active ignition system overcomes all of these design issues allowing any one of a number of high temperature incendiary high explosive fills to be employed. The exact geometry of a high temperature incendiary countermine dart incorporates the cavity generating design features allowing hydrodynamic cavitation and terradynamic cavitation to be employed in high-speed penetration of soil and water, and an active ignition system to allow the dart fill to be shocked to reaction using a high temperature incendiary fill. The darts would also incorporate a staggered tail system to allow maximum number of darts to be packaged in the countermine munitions dispensing system.

U.S. Pat. No. 5,859,383 describes an innovative, safe, explosive device. The device has many potential fields of utility, including, but not limited to mining, oil exploration, seismology, and particularly to shaped charges. These shaped charges may be used as a well perforation system using energetic, electrically-activated reactive blends in place of high explosives. The reactive blends are highly impact inert and relatively thermally inert until activated. The proposed system requires no conventional explosives and it is environmentally benign. The system and its components can be shipped and transported easily with no concern for premature explosion. It also needs no special handling or packing. The performance in oil and gas well perforation can be expected to exceed that of conventional explosive techniques. The device is a shaped charge capable of projecting a mass which can perforate a solid object, said shaped charge comprising: a) a casing, b) an electrical connection means though said casing, c) a reactive mass within said casing, wherein said reactive mass is electrically conductive along its entire length, and said casing encloses said reactive mass, said reactive mass comprising an electrically conductive reactive material in association with an oxidizing agent. A preferred composition and method comprises an electrically conductive reactive mass comprises a distribution of aluminum metal and an oxidizing material which will oxidize said aluminum metal at a temperature of at least 1000 degree K. and activating said electrically conductive reactive mass with a pulsed electrical charge of at least 1 kJ/gram of aluminum in less than 20 microseconds.

U.S. Pat. No. 6,357,356 (Rim et al.) relates to an electric blasting device using aluminum foil, the objective of which lies in providing an economical and safe electric blasting device. In line with this objective; a portion of the outer conductor of the cable is removed, and the aluminum foil is inserted therein in order to electrically connect the inner and outer conductors. Between the aluminum foil and the inner conductor, water, an insulator, and a Teflon® polytetrafluoroethylene polymer tube are inserted. When pulse high-current is made to flow, the aluminum foil changes into the condition of plasma. The aluminum therefrom and water react to generate explosive power. The invention uses commercialized aluminum foil, in addition to having a short scattering distance of the fragments. It also allows a low-vibration blasting due to the short reaction time therein. U.S. Pat. No. 5,436,791 describes a perforating gun using an electrical safe arm device and a capacitor exploding foil initiator device. The capacitor exploding foil initiator device having a capacitor connected in parallel to a bleed resistor which are connected across an exploding foil initiator by an over-voltage gap switch. When a voltage of the capacitor reaches a breakdown voltage of the switch, the energy stored in the capacitor is discharged through the switch to the exploding foil initiator which initiates a detonator cord thereby detonating the shaped charges of the perforating gun.

U.S. Pat. No. 6,389,975 describes a switching circuit incorporating a Field Effect Transistor (FET), two series dual-tap gas tube surge arrestors, and high-voltage resistors as part of a high voltage switch of a fireset for initiating an exploding foil initiator (EFI). Until energizing the FET via a firing command, an operating voltage of 1000 V is held off by a combination of the surge arrestors and high-voltage resistors.

Upon receipt of a firing signal, a 28 V source is used to energize the FET that, in turn, decreases the voltage across the one surge arrestor connected directly to ground and increases the voltage across the other surge arrestor. Upon reaching the breakdown voltage of the ionizable gas within the second surge arrestor, the gas ionizes, becomes electrically conductive, and dumps the second surge arrestor's voltage across the first surge arrestor. This causes the first surge arrestor to also break down. Both surge arrestors are now conducting. Thus, the 1000 V source is free to energize the remainder of the circuit, discharging a 0.20 micro(f) capacitor through the EFI. The breakdown of both arrestors occurs in nanoseconds, enabling an almost instantaneous initiation signal.

Explosive materials are known to be ignited in different ways. Typically, explosive materials have been ignited by flame ignition (e.g., fuses or ignition of a priming explosive), impact (which often ignites a priming explosive), chemical interaction (e.g., contact with a reactive or activating fluid), or electrical ignition. Electrical ignition may occur in two distinct ways, as by ignition of a priming material (e.g., electrically ignited blasting cap or priming material) or by direct energizing of an explosive mass by electrical power. U.S. Pat. No. 5,351,623 describes a device which safely simulates the loud noise and bright flash of light of an explosion. This device consists of an ordnance case which encloses a battery, an electronic control module, a charging circuit board, a bridge head, and a shock tube dusted with aluminum and an explosive. The electronic control module provides a time delay between initial activation of the device and the time when the device is ready to create a shock wave. Further, this electronic control module provides a central control for the electronics in the simulator. The charging circuit board uses the battery to charge a capacitor. Passing the voltage stored in the capacitor through the wires of the bridge head causes the explosive and the aluminum in the shock tube to react. This reaction produces a loud noise and bright white flash of light which simulates an explosion.

One other aspect of explosive devices which has been of great concern is the danger of premature detonation of the device or charge. The highly energetic release of the compositions used for providing explosions has usually been attended by a high degree of sensitivity or a low initiation threshold for the explosive reaction. Attempts at alternative energy sources for explosive devices have led in many directions, including the electrical ignition of metals in water. W. M. Lee, Metal/Water Chemical Reaction Coupled to a Pulsed Electrical Discharge, J. Appl. Phys. 69 (10), 15 May 1991 describes how capacitor stored energy is transferred to a wire conductor surrounded by a mixture of a reactive metal powder and water. The current explodes the small wire conductor and initiates a chemical reaction in the mixture. The chemical reaction in the mixture was direct reaction of the aluminum metal and the water as $$2Al+3H_2O \text{ goes to } Al_2O_3+3H_2$$

to provide the energy for the investigation of explosive sources.

T. G. Theofanous, X. Chen and P. Di Piazza, Ignition of Aluminum Droplets Behind Shock Waves in Water, Phys. Fluids 6 (11), November 1994, pp. 3513-15 describes the reaction of gram quantities of molten aluminum with water under sustained pressure pulses of up to 40.8 Mpa in a hydrodynamic shock tube. Conditions are identified under which the thermal interaction develops into chemical ignition and total combustion events in the aluminum-water explosion.

Electrically triggered explosive devices are not per se novel. Electrical current has been used for more than one hundred years to ignite detonators, as for example with TNT or dynamite charges. Electrical signals are also used with modern explosive devices, including Explosive Bridge Wires and their membrane equivalents. Explosive bridge wires are thin wire(s) placed adjacent to an explosive charge. The wire (s) or membranes (exploding foil initiators) are very thin and have very low mass relative to the total mass of the charge (considerably less than 1% by weight). These films or wire(s) are placed adjacent to the explosive mass, and are electrically connected to a charge generator. The charge causes the wire to burst, creating a shock wave into and through the explosive material which initiates or enhances the explosive effect of the charge. The products of the reaction may react with the burst wire or foil in a redox reaction.

The nature of explosions and ignitions also varies according to different needs. For example, some ignitions (as described in U.S. Pat. No. 6,540,175) are seeking high temperature ignitions to initiate thermal reactions in proximity to the ignition of the incendiary fill. Other explosive materials seek to provide high pressures to impact and act on materials in close proximity to the blast. Each of these different techniques among ignition types and explosion effects requires differentiation among the materials used and the ignitions provided in the practice of the technologies. All of the above cited references are incorporated herein by reference for all of their teachings relating to the field of explosives, activators, detonators, electronics, materials and the like.

SUMMARY OF THE INVENTION

An explosive device comprises a phase-changing (e.g., evaporation, rapid sublimation, direct solid to vapor transition, etc.) metal composition and a mixture of at least two polymeric materials. A first polymeric material comprises a backbone with at least 15% by weight halogen atoms bonded thereto and a second polymeric material comprises a backbone with less then 15% by weight halogen atoms bonded thereto. The metal composition may, for example, comprise aluminum and the first polymer may comprise a backbone with at least 25% by weight halogen atoms bonded thereto, such as polytetrafluoroethylene or other highly fluorinated polymers. The system may be restrictively activateable, being capable of being activated only with at least an electrical pulse of at least 1.0 KJ/gAl in less than 100 milliseconds.

BRIEF DESCRIPTION OF THE FIGURES

FIG. 1 is a graph of Pressure versus Energy for blends of Teflon® polymer and Mylar® polyester.

FIG. 2 is a plot of the gas product concentrations for values of $R_{Te}$ between 0.43 and 1.00.

FIG. 3 graphs condensed chemistry for an aluminum, Teflon® polymer and Mylar® polyester reaction.

DESCRIPTION OF THE INVENTION

The present invention provides for a high energy, stable, electrically activated explosive replacement that comprises at least a mixture of a metal, a highly-halogenated polymer moiety (HHPM) and a reduced (or non-) halogenated polymer moiety (RHPM). These replacements can also be used as detonators for other explosive systems and materials. The two polymer moieties, the HHPM and RHPM, may be provided in the following manners and generally in the following proportions. The halogen on the polymer preferably comprises chlorine or fluorine, preferably fluorine, and preferably at least 50% of halogen atoms in the polymer comprise fluorine. The fluorine is preferably provided on the polymer backbone (as in polymers formed from ethylenically unsaturated monomeric units such as tetrafluoroethylene, trifluoromonochloroethylene, difluorodichloroethylene, trichloromonofluoroethylene, trifluoroethylene, and the like). The polymers may be homopolymers, copolymers, or have more copolymerized moieties. The polymers may be random copolymers, block copolymers, or physical mixtures of different polymers, and the like.

It has been found that the use of combinations of HHPM and RHPM performs significantly better as electrically activated explosive replacements. This will be evidenced by data provided herein. Typical HHPM will have equal to or greater then 40% by weight halogen components in the polymer, and typical RHPM will have less then 40% by weight halogen components in the polymers. In calculating these values, for example, tetrafluoroethylene has 2 carbon atoms (MW 12%) and four fluorine atoms (MW~19%) for a total molecular weight of 100 (2×12 plus 4×19) and a percentage fluorine of 76/100×100% or 76%. For a chlorine equivalent, the maximum percentage would be 2×12 plus 4×35.5=166 and 142/166×100% or 85.4% chlorine. When describing copolymers or block copolymers or the like, the proportion of moieties in the polymer would be used and averaged in determining the percentage. The blend of polymer moieties and/or polymers themselves should be provided in proportions that provide a material that provides improved explosive effects as compared with an individual polymer moiety or individual polymer. Ratios of fluorine contents (percent weight molecular weight or number average molecular weight) average between HHPM and RHPM can also be expressed. Ratios of HHPM/RHPM of at least 1.1, 1.2, 1.5, 1.7, 2.0, 2.5, 3.0, 3.5, 4.0 up to essentially infinity (as long as the HHPM has at least 40% by weight halogen components) can be used. The limit of infinity would be reached where the RHPM had no fluorine content and the HHPM had at least 40% by weight fluorine content.

It is generally expected that the blend of HHPM and RHPM polymer moieties or polymers shall have a halogen content percentage that is dependent upon both the type of explosive effect desired and the particular halogen used. As noted above, the maximum percentage differs significantly (e.g., 76% versus 85% depending upon the halogen, with even a greater range of differences possible if iodine or bromine were used) between materials. It may even be better to consider the halogen on a molecular basis, where (with an ethylenically-based monomer) the halogen would be approximately 50% (actually slightly less because of terminating groups) on a molecular basis. With an HHPM, the polymer should have at least (equal to or less then) 25% moles halogen content and a RHPM should have less then 25% molecular basis halogen. The total mixture of HHPM and RHPM moieties should be optimized for properties, but will generally be between 15-75% weight basis halogen, between 15-70% weight basis halogen, 20-65% halogen, 25-60% weight basis halogen; 10-45% molecular basis halogen, 12-40% molecular basis halogen, and 15-38% molecular basis halogen. These ranges can be readily achieved by the ordinarily skilled artisan by blending polymers, mixing different proportions of comonomers, and the like.

Examples of RHPM polymers and moieties are polyesters (e.g., polyethylene terephthalate), polyolefins (polyethylene, polypropylene, polystyrene, etc.), polyvinyl resins, polyamides, polyethers, polycarbonates, polyketones, polyurethanes, and the like. It is preferred that non-elastomeric polymers be used and that polymers with relatively lower incineration/ignition temperatures (e.g., less then 800° C., less then 700° C., and less then 600° C.) be used.

One approach of the present invention is to activate reactive blends of metals and oxidizing agents with energetic electrical pulses from a pulsed-power system. Theoretical predictions of pressures and expansion histories can be verified by testing reactive samples activated with energetic electrical pulses. The energy source of choice is a conductive material which can be burst (e.g., melted and vaporized by pulsed electrical current). Of particular interest are conductive materials such as graphite, conductive polymers and metal such as aluminum, zirconium, copper, titanium, lithium, silver, magnesium, beryllium, manganese, tin, iron, nickel, zinc, boron, silicon and the like in an oxidizing environment, or an environment which becomes oxidizing during the pulsing, bursting and subsequent reaction initiation. It is also desirable to have a power source and conductive path to the reaction mixture that will remain effective in the difficult temperature, stress, and shock environment in which the unit will be employed. Known short pulse, high intensity electrical systems can be used on the systems. Long pulse high intensity electrical systems could also be used on the present systems. An example of an electrical system capability would be one that provided at least 0.1, 0.5, 1.0, 1.5, 2.0 or at least 2.5 kiloJoules/gAl (kilojoules per gram mass of Aluminum in the charge) in a millisecond time frame (e.g., less than 100 milliseconds, such as in 1-100 milliseconds, 1-70 milliseconds, 1-50 milliseconds, 5-50 milliseconds, 10-50 milliseconds, and the like, with, of course, shorter time periods being acceptable). Any higher pulse intensity, with longer or shorter duration could be used as long as the requisite energy is provided in a short enough period of time for rapid energy delivery to the aluminum to begin the explosive (explosive or initiation) process. Energies levels of at least 3.0, 3.5, 4.0, 5.0, 6.0, 7.0, 8.0, 10, 15, 20, 25 kiloJoules/gAl would of course be useful and essentially any higher amount of energy would be useful, unless wires from the electrical source to the Aluminum were destroyed before delivery of the current pulse.

The detonation materials and systems of the invention may be used both as the explosive system per se or as an initiator or detonator. The use as an initiator or detonator provides additional unique benefits. As with the materials when used as the explosive device, the initiators can be prepared without any conventional explosive material present (such as black powder, dynamite, C-4, plastic explosives, nitrate explosives, hydrocarbon-based explosives, hydrazine-based explosives, and chemical explosives or the like) in the component, element, casing or housing. This stable system described herein prevents the possibility of ambient conditions detonating the initiator or detonation system of this technology. This enables safe transportation of the initiators or detonation systems of the invention, reduced insurance needs, and safe utility of the system in environments where conventional explosives could not be used. For example, the safe systems of the invention could be transported to and through extremely hazardous environments (e.g., high temperature environments, explosive gas environments, toxic gas environments, fires, industrial conditions, well drilling conditions, mining conditions, etc.) without any reasonable fear of premature explosion, This creates not only a safer environment, but also can avoid the need to stop operation at a site (e.g., an oil drilling rig or well, mining site or mine, road construction, building demolition, etc.) while the detonator or initiator is situated. As conventional temperatures at these sites could not trigger detonator of the systems described herein (especially where no additional explosive is included), the initiators or detonators could be situated while work continues, and then detonated by electrical impulse at the convenience of the site operation. These systems could also be used to initiate firework displays, where existing systems have high insurance costs because of the danger involved with both the fireworks themselves and the initiation/firing system.

The technology will be described primarily using aluminum as a basis of discussion, although it is clear that the description is intended to be more generic in all aspects of the invention, yet still be within the improved practice of the invention. For example, the reactive mass may comprise an electrically conductive distribution of metal (such as zirconium or preferably aluminum metal) and a material which will oxidize said metal at a temperature of at least 1000 degree K, and usually between 1000 degree K and 7000 degree K. The reactive mass distribution or mixture is oxidatively stable at room temperature (that is, less than 5% by weight of the aluminum will oxidize at 25 degree C. in a thirty day period while in contact with only said material within the casing and liner which will oxidize said aluminum metal at the elevated temperature range) and may be activated or detonated by a pulsed electrical charge of at least 1 kJ/gram of aluminum, often at least 3 or 5 kJ/g, preferably at least 7 kJ/g, and under some circumstances at least 10 kJ/gram of reactive mixture (e.g., the total combined weight of aluminum and oxidative coating). This high energy/volume of pulsed power should be delivered in proportion to the total mass and/or length of the explosive mixture. A general guideline is that the duration of the pulse should be less than about 100 microseconds per gram of reactive mixture for conventional type explosive devices. As the length of the mixture (by way of shape or mass increasing the dimension along which the activating pulse charge must flow), the duration of the pulse must also increase. For shaped charges, the guideline is that less than about 0.20 microseconds/gram, preferably in less than 0.15 microseconds/gram, and more preferably less than 0.10 microseconds/gram. Commercially available generators are capable of providing that energy fluence necessary for initiating and maintaining the reaction in less than 5 or even less than 2 microseconds.

Another aspect of the present invention is the fact that an absolute minimum pulsed charge must be present to initiate the explosion. Running smaller currents through the reactive mass may cause progressive oxidation, but will not initiate the bursting and rapid oxidation that is part of the reaction scheme in the use of the explosive device of the present invention. This threshold pulse value will be dependent upon both the size of the reaction mass, the length of the mass, and the specific reactive conductor (e.g., metal) and oxidizing agent selected. For the non-shaped, non-jet charges, the threshold value (and fluence, i.e., energy/time, such as kJ/g/microsecond) is lower than for the jetting shaped charges (such as the perforators of the present invention). For a simple explosive device, there could be a minimum threshold fluence of 0.1 kJ/g/50 microsecond, 0.3 kJ/g/25 microsecond, or 0.5 kJ/g/20 microsecond and higher. For the shaped, jet producing charges, such as the perforators, this threshold fluence could be at least 0.5 kJ/g/25 microsecond, or 1, 3, 5 or even 10 kJ/g/20 microsecond. This feature provides a level of safety for the explosive device that can be controlled to a point where not even a bolt of lightening will cause premature detonation of the explosive device. As noted herein, the system may be restrictively activateable, being capable of being activated essentially only with at least an electrical pulse of at least 1.0 KJ/gAl in less than 100 milliseconds. By this terminology it is meant that if a pulse of less than that energy (e.g., less than 1.0 kiloJoules/gAl) over that period of time (e.g., 100 milliseconds) is used, the system will not be activated. Similarly, if that energy (at least 1.0 kiloJoules/gAl) is provided in a time frame greater than recited (e.g., significantly greater than 100 milliseconds), the system will not be activated. The term activated means that at least 10% of the detonation potential energy available from the system is released within at least 110% of the recited time frame (leaving a small induction period, if it occurs). For example, 100% of the explosive energy could be release by electrically heating the materials over a three day period, causing an oxidation-reduction reaction to occur between the materials. That would not be considered to be activation, but rather merely electrically (or thermally activated burning/oxidation of the materials. Only an event that produces an explosive or shockwave or thermal wave reaction, stimulated by a metal phase change (e.g., immediate change from solid to gas phase in the 100 millisecond time frame, or less) caused by electrical heating of the metal, is considered to be activation.

The reactive mass has been described as a conductive reactive mass. This means that the pulsed charge must have a continuous conductive path through the reactive mass. A suspension of conductive particles in an insulating, albeit oxidative medium, would not be able to provide the continuous reactive path desirable for the reaction to proceed along the entire length of the reactive mass. By conductive it is generally meant that at room temperature and ambient conditions at voltage levels which do not significantly alter the conductive properties of the material itself (as would the bursting pulses used in the present invention), the reactive mass (through the conductive element) would display a resistance of greater than 1 microohm-cm and less than 100 microohm-cm.

Oxidant/Polymer Chemistry

The polymers polyethylene terephthalate (PET, known under the trade name Mylar™) and poly-tetrafluoroethylene (PTFE, known under the trade name Teflon™) contain 33% and 76% oxidant (as oxygen and fluorine, respectively) by mass. With the thermochemical equilibrium code CHEETAH [L. E. Fried, W. M. Howard, and P. C. Souers, *Cheetah* 2.0 *User's Manual*, UCRL-MA-117541, rev. 5, Lawrence Livermore National Laboratory, August 1998], the applicant analyzed both polymers and found an optimum combination of the two in which $R_{Te}$=0.75, where $R_{Te}$ is the ratio of the mass of the Teflon to the mass of the combination.

FIG. 1 is a plot of the constant-volume pressure $P_{CV}$ (assuming zero deposition), the burst (peak) pressure $P_{Burst}$ (assuming a deposition of 10 kJ/gm, just enough to vaporize the aluminum), and the energy efficiency $E/E_0$. The latter is the ratio of the reaction energy (E) to the deposition energy ($E_0$). The applicant considered two cases: $R_{Al}$=0.25 and $R_{Al}$=0.27, where $R_{Al}$ is the ratio of aluminum mass to the total mass; both ratios were close to the stoichiometric value for which the oxidant is completely consumed by the aluminum.

An oxidant blend containing approximately 75% Teflon™ by mass (with $R_{Te}$=0.75) gave the highest pressure. The combination with $R_{Al}$=0.25 (25% aluminum by mass) was more efficient than the one with $R_{Al}$=0.27. The oxidizing material does not have to provide oxygen itself as the oxidizer, but may provide fluorine, chlorine, bromine, iodine or other mono-di-, tri- or tetra-atomic atomic oxidizing agents (e.g., O.sub.2, F.sub.2, CO, NO.sub.2, etc.) into the environment at the elevated temperatures so as to react rapidly with the aluminum. Polytetrafluoroethylene (e.g., Teflon™, Kevlar™, highly fluorinated (or halogenated) organic compounds and materials, highly oxygenated materials (e.g., polyethers, peroxides, and the like), and mixtures, solutions, emulsions or dispersions of such materials may be used to provide the oxidizing materials at the elevated temperatures brought on by the pulsed detonation signal and/or the initial reaction brought on by the pulsed signal. The oxidizing material may be comprise more than one material and may be placed into more than one position. For example, one type of oxidizing material may be an insulating cover on the wires, and another oxidizing material may be present between the insulated wires, powders, films, sheets, or other form of the metal.

The metal may be provided, as indicated above, in various high surface area forms. In particular, fine metal powders, thin films (as sheets, folded sheets, crumpled sheets), and wires are preferred structures. The polymeric materials may be provided as physical mixtures with the metal, coatings on the metal, films, or combinations thereof. For example, with a film of metal, the polymeric material (the HHPM and RHPM moieties) may be provided as a coating on one or both sides of the metal film. The polymer may also be provided as powders adhered to the film surface or layered between sheets of metal film. When powders are used, it is preferred that the average size of metal and polymer particles do not differ by more than 50% average particle size for purposes of simplifying packing and reducing the effects of redistribution of materials because of size differences.

FIG. 2 is a plot of the gas product concentrations for values of $R_{Te}$ between 0.43 and 1.00. When $R_{Te}$ increased above 0.70, the amount of gas produced by the reaction decreased. As shown in FIG. 3, when $R_{Te}$ increased above the value 0.70, much of the $AlF_3$ produced by the reaction was in a condensed state. The rise in temperature was not enough to overcome the loss in gas volume, so the pressure fell as $R_{Te}$ rose above 0.75 (FIG. 1).

An initiator is another specialized use of technology related to the disclosed technology that has its own unique niche within the field. An initiator is a system that may itself be activated or exploded to initiate a second system of different chemistry than the initiating system. Gunpowder blasting caps for dynamite are an example of an initiator system. The usual indication of an initiation system in combination with a primary detonation system is that the initiation system is usually the first of two integrally associated (usually in direct physical contact, although a cover, sleeve, film, etc. may separate them for various purposes) but chemically distinct compositions that receives the initial energy used to set off the energy of the system (hence a fuse goes to a blasting cap, an electrical charge goes to a blasting cap or detonator head, etc.) provides a significantly lower total amount of explosive energy to the complete detonation process. Typically, initiators will produce less than 25%, less than 20%, less than 15%, less than 10%, less than 8%, less than 6%, less than 5%, less than 4%, less than 3%, less than 2% and less than 1% of the total explosive energy provided by the initiator material and the primary explosive material. These proportions can be based on actually optimal energy tests or theoretical tests, but should be so stated in any ratio. The primary explosive can be initiated by either shock wave, incendiary action, or heat generated by the initiator system.

Although the practice of technology described herein has been presented in terms of specific materials, proportions, conditions, sources, and the like, the concepts are generic in nature and are not to be considered limited by the number of examples provided. The terminology used in describing ranges and limitations is intended to be flexible. For example, the electrical initiation system may be based upon known technology in any electrical field wherein sufficient electrical energy can be transferred in a short enough period of time to effect the explosive evaporation of the aluminum to initiate an explosion. Such additional electronics are described in *HIGH COULOMB TRIGGERED VACUUM FLASHOVER SWITCH*, R. D. Ford et al., Science Applications International Corporation, Albequerque, N.M. 87106, presented at 1997 IEEE as 0-7803-4214-3/97, which is incorporated herein by reference in its entirety.

What is claimed is:

1. A method of igniting an explosive device comprising providing an electrical pulse to the explosive device comprising a high pressure-producing metal composition comprising:

a metal; and at least two polymeric materials, wherein a first polymeric material comprises a backbone with at least 15% by weight halogen atoms bonded thereto and a second polymeric material comprises a backbone with less then 15% by weight halogen atoms bonded thereto, the electrical pulse being of sufficient energy and duration as to vaporize at least some metal and cause the explosive device to explode; and wherein the first polymeric material is present in a ratio of at least 3/4 with respect to the metal.

2. The method of claim 1 wherein the metal is selected from the group consisting of aluminum, zirconium, copper, titanium, lithium, silver, magnesium, beryllium, manganese, tin, iron, nickel, zinc and boron.

3. The method of claim 2 wherein the second polymer is selected from the group consisting of polyesters, polyolefins, polyvinyl resins, polyamides, polyethers, polycarbonates, polyketones and polyurethanes.

4. The method of claim 3 wherein the first polymer comprises a highly-fluorinated polymer having at least 40% by weight fluorine derived from at least one moiety selected from the group consisting of tetrafluoroethylene, trifluoromonochloroethylene, difluorodichloroethylene, trichloromonofluoroethylene and trifluoroethylene.

5. The method of claim 2 wherein the first polymer comprises a highly-fluorinated polymer having at least 40% by weight fluorine derived from at least one moiety selected from the group consisting of tetrafluoroethylene, trifluoromonochloroethylene, difluorodichloroethylene, trichloromonofluoroethylene and trifluoroethylene.

6. The method of claim 1 wherein the metal comprises aluminum and proportions of aluminum to the at least two polymers comprises about 0.25 mass aluminum to total mass of the high pressure-producing metal composition.

7. The method of claim 1 wherein the first polymeric material comprises a backbone with at least 25% by weight fluorine atoms bonded thereto and a second polymeric material comprises a backbone with less then 15% by weight halogen atoms bonded thereto, the electrical pulse being of sufficient energy and duration as to vaporize at least some metal and cause the explosive device to explode;

wherein the first polymeric material is present in a ratio of at least 3/4 with respect to the metal;

wherein the metal is selected from the group consisting of aluminum, zirconium, copper, titanium, lithium, silver, magnesium, beryllium, manganese, tin, iron, nickel, zinc and boron; and wherein the first polymer comprises a highly-fluorinated polymer derived from at least one moiety selected from the group consisting of tetrafluoroethylene, trifluoromonochloroethylene, difluorodichloroethylene, trichloromonofluoroethylene and trifluoroethylene.

8. The method of claim 7 wherein the second polymer is selected from the group consisting of polyesters, polyolefins, polyvinyl resins, polyamides, polyethers, polycarbonates, polyketones and polyurethanes.

9. The method of claim 8 wherein the second polymer contains 0% by weight halogen.

10. The method of claim 9 wherein the metal comprises aluminum and proportions of aluminum to the at least two polymers comprises about 0.25 mass aluminum to total mass of the high pressure-producing metal composition.

11. the method of claim 8 wherein the first polymer is derived from tetrafluorothylene and the second polymer comprises polyethyleneterephthalate.

12. The method of claim 8 wherein pressure produced upon vaporization exceeds 60 kbar at burst.

* * * * *